US007520128B1

(12) United States Patent
Rosa et al.

(10) Patent No.: US 7,520,128 B1
(45) Date of Patent: Apr. 21, 2009

(54) METHOD FOR AUTOMATICALLY CYCLING A TORQUE WRENCH

(75) Inventors: Peter A. Rosa, Tomball, TX (US); John Micallef, Manilva (ES)

(73) Assignee: Titan Technologies International, Inc., Houston, TX (US)

( * ) Notice: Subject to any disclaimer, the term of this patent is extended or adjusted under 35 U.S.C. 154(b) by 0 days.

(21) Appl. No.: 12/057,061

(22) Filed: Mar. 27, 2008

(51) Int. Cl.
*F15B 11/00* (2006.01)
*B25B 23/14* (2006.01)

(52) U.S. Cl. ..... 60/379; 81/470

(58) Field of Classification Search ..... 60/369, 60/379, 381; 81/469, 470, 479
See application file for complete search history.

(56) References Cited

U.S. PATENT DOCUMENTS 2,790,340 A * 4/1957 Cross ..... 60/379
4,513,644 A 4/1985 Weyer
4,823,616 A * 4/1989 Tambini ..... 81/470
4,864,903 A 9/1989 Bickford et al.
4,941,362 A 7/1990 Tambini
5,007,153 A * 4/1991 Junkers ..... 29/407.02
6,112,622 A 9/2000 Reiman
6,532,845 B1 * 3/2003 Reiman ..... 81/57.39
7,062,993 B2 * 6/2006 Shaw et al. ..... 81/57.39
2005/0210872 A1 * 9/2005 Wagner ..... 60/431
2007/0214921 A1 * 9/2007 Fechter et al. ..... 81/467

* cited by examiner

*Primary Examiner*—Thomas E Lazo
(74) *Attorney, Agent, or Firm*—Buskop Law Group, PC; Wendy Buskop

(57) ABSTRACT

A method for automatically cycling a torque wrench. The method includes providing a hydraulic torque wrench. Providing an actuating device on the hydraulic torque wrench. Providing a switching device on the hydraulic torque wrench. Adapting the switching device to be activated by the actuating device when a piston of the torque wrench is at the end of a stroke. The embodiments of the method allow a user to ensure that a proper torque on a threaded fastener is achieved. This ensures that the pressure achieved within the system is a result of a proper torque applied to a threaded fastener being achieved, and not a result of the piston at the end of its stroke.

7 Claims, 3 Drawing Sheets

METHOD FOR AUTOMATICALLY CYCLING A TORQUE WRENCH

FIELD

The present embodiments relate to an automatic torque regulating hydraulic torque wrench system.

BACKGROUND

A need exists for a method to automatically cycle and to communicate with a hydraulic pump to ensure that correct torque is achieved. The method needs to determine when the pressure builds up in a hydraulic pump and cylinder is because of the force exerted on a threaded fastener and not due to build up at the end of the stroke of the piston within the hydraulic wrench itself.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a method for automatically cycling a torque wrench. The method can include the step of providing a hydraulic torque wrench. After the torque wrench is provided, a magnet is disposed on the hydraulic torque wrench. It is contemplated that the magnet can be secured to a piston rod of the hydraulic torque wrench. However, the magnet can also be secured to a housing of the hydraulic torque wrench.

The method can also include providing a switching device on the hydraulic torque wrench. The switching device can be secured to the housing of the hydraulic torque wrench if the magnet is disposed on the piston rod. In the alternative, the switching device can be provided on the piston rod and the magnet can be disposed on the housing.

The switching device is adapted to be activated by the magnet when the piston rod of the torque wrench is at the end of a stroke. For example the switching device can be secured on the housing. The position of the switching device can be such that the magnet will activate the switching device only when the piston rod is at full stroke.

The hydraulic torque wrench can be in fluid communication with a directionally controlled pump. An output pressure of the directionally controlled pump is set. For example the output pressure can be set at 1500 psi if the torque required is 175 ft/lbs. The pressure output required for a specific torque is a function of the specific torque wrench and the calculations are well known to one skilled in the art.

The method can further include the step of communicating the directionally controlled pump with a processor. The processor can also be in communicated with the switching device. The method can further include adapting the processor to cycle the directionally controlled pump when the switching device is activated.

The method can also include sensing the output pressure. For example a pressure transducer can be disposed on the directionally controlled pump for sensing the pressure leaving the directionally controlled pump. The sensed output pressure can be communicated to the processor.

An embodiment of the method can include stopping the directionally controlled pump when the sensed output pressure reaches the preset pressure and the switching device is not activated.

In another embodiment of the invention an activation device can be used instead of a magnet. For example the activation device can be a mechanical switching device or a laser.

The embodiments of the invention can be best understood with reference to the figures.

Figure 1:
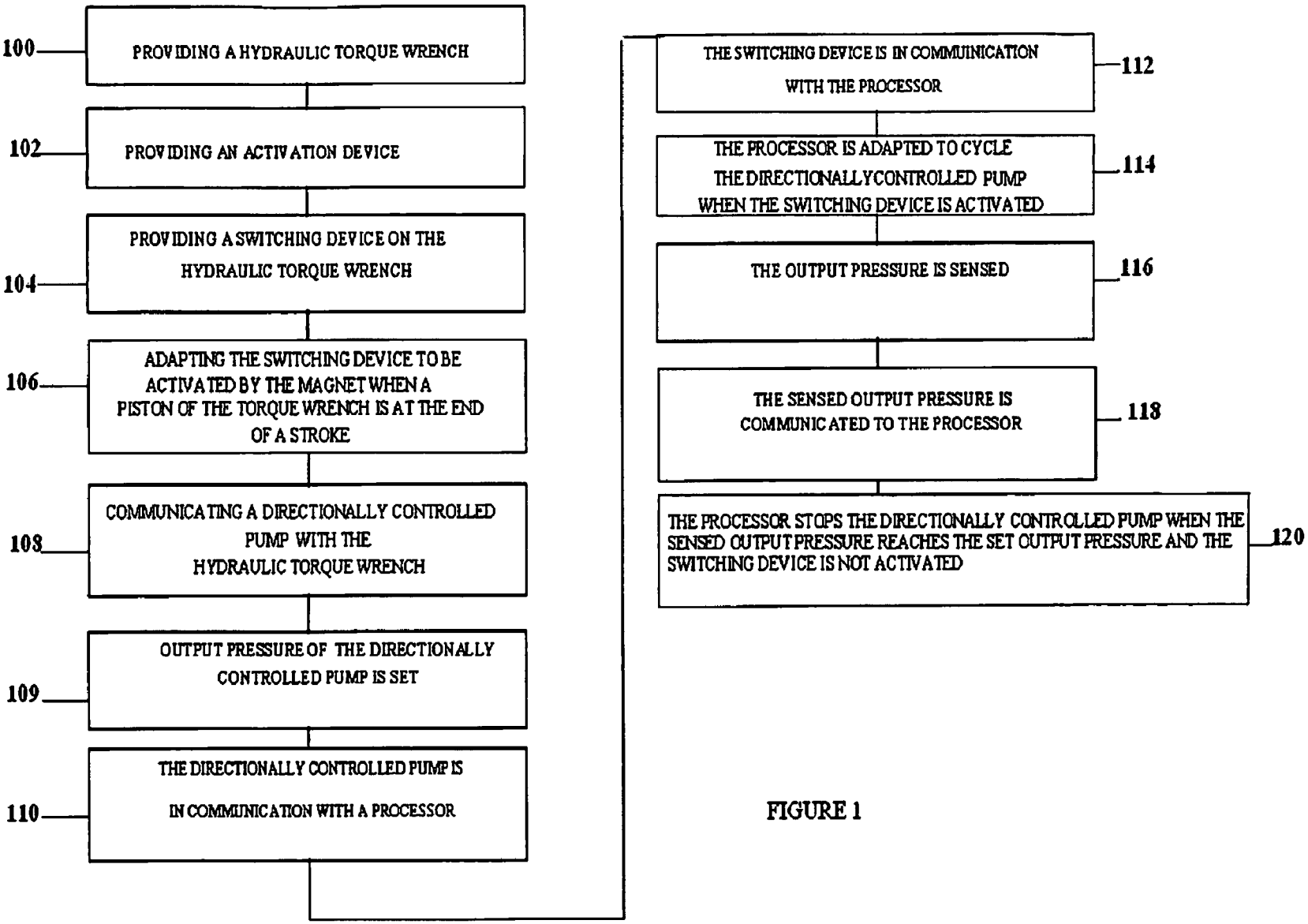
FIG. 1 depicts a flow diagram of an embodiment of the method.

FIG. 1 depicts a flow diagram for an embodiment of the invention. The depicted embodiment for a method for automatically cycling a torque wrench includes step 100 which is providing a hydraulic torque wrench. The torque wrench can be a T Series or LP Series tool Manufactured by Titan Technologies International, Inc., of Houston, Tex.

After step 100 is step 102 providing an activation device. The activation device can be a mechanical switch, a laser, a magnet, or can utilize BlueTooth™ technology. The activation device can be movably mounted on the hydraulic torque wrench, for example on the piston rod, or the activation device can be non-movably mounted on the hydraulic torque wrench, for example on the housing.

Step 104 is providing a switching device on the hydraulic torque wrench. The switching device can be mounted on the hydraulic torque wrench in either a movable or non-movable fashion depending on how the activation device, such as the magnet, is mounted on the hydraulic torque wrench. For example, if the magnet is movably mounted on the hydraulic torque wrench then the switching device will be non-movably mounted on the hydraulic torque wrench.

After step 104 comes step 106. Step 106 includes adapting the switching device to be activated by the magnet when a piston of the torque wrench is at the end of a stroke. Step 108 includes communicating a directionally controlled pump with the hydraulic torque wrench.

In step 109 the output pressure of the directionally controlled pump is set. For example the output pressure can be set at 1500 psi. In step 110 the directionally controlled pump is in communication with a processor. For example the processor can be hardwired to the directionally controlled pump, the processor can be a integrated hardware component of the directionally controlled pump, or the processor can be communicated to the directionally controlled pump using commonly known wireless communication.

In step 112 the switching device is in communication with the processor. That is the processor will receive a signal when the switching device is activated. For example a electrical circuit can be completed by sending the signal to the processor.

Then in step 114 the processor is adapted to cycle the directionally controlled pump when the switching device is activated. The switching device can cause the valves of the pump or can activate an instantly reversing pump to pump in the other direction.

In step 116 the output pressure is sensed. For example a pressure transducer can be used to determine the output pressure of the directionally controlled pump. In step 118 the sensed output pressure is communicated to the processor.

In step 120 the processor stops the directionally controlled pump when the sensed output pressure reaches the set output pressure and the switching device is not activated.

Figure 2:
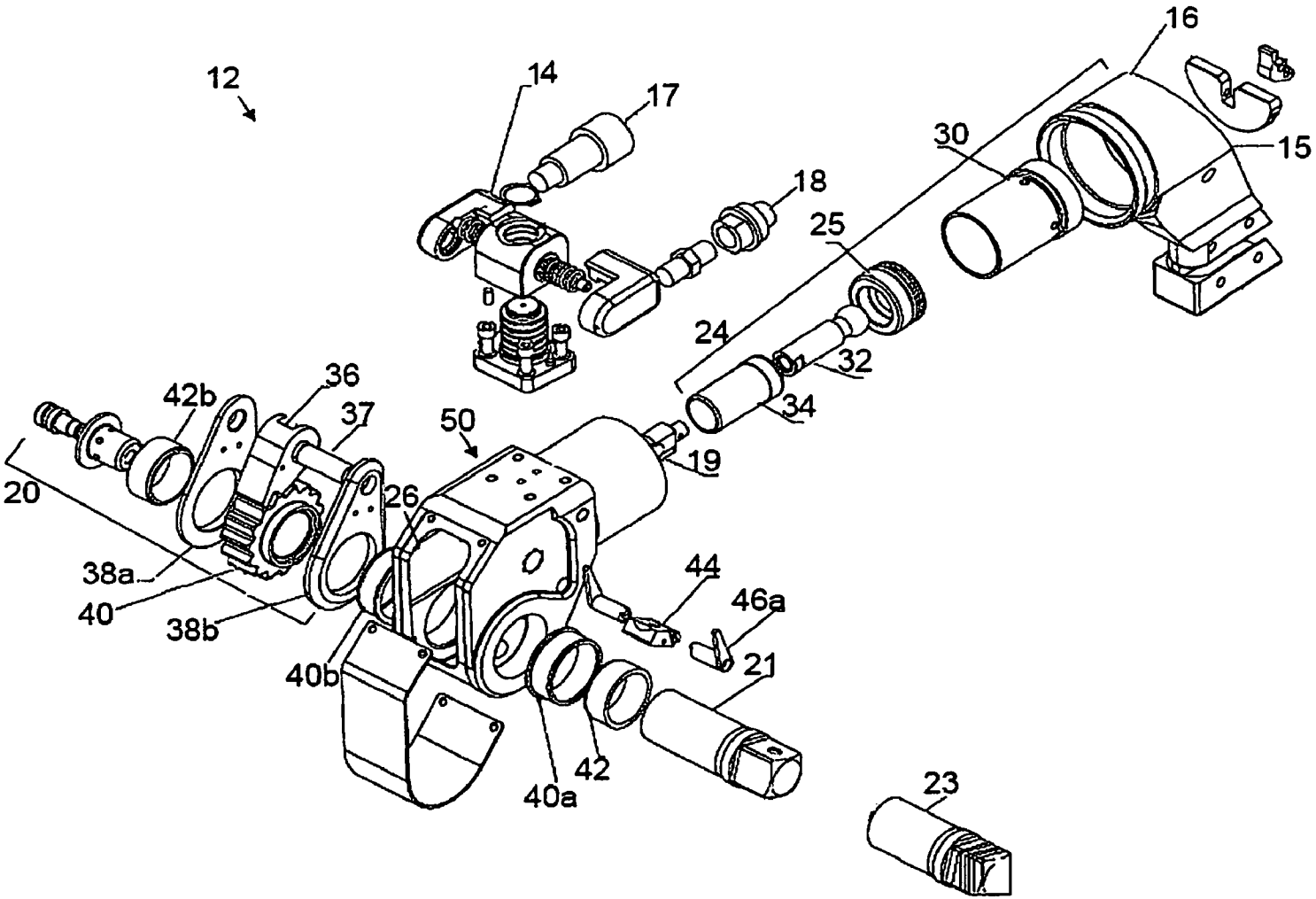
FIG. 2 depicts an exploded view of an embodiment of a hydraulic torque wrench usable with the embodiments of the invention.

Referring now to FIG. 2, an exploded view of an embodiment of the hydraulic torque wrench 12. In the depicted embodiment the hydraulic torque wrench has a housing 50.

A fluid portion 14 is secured to a terminal portion 15 of the hydraulic torque wrench 12. The fluid portion activates a hydraulic piston assembly 16. The hydraulic piston assembly 16 is depicted including a piston 25. The hydraulic piston assembly 16 further comprises an end cap 30 for holding the piston 25 and a piston rod 32 enveloped in a piston sleeve 34.

Figure 3:
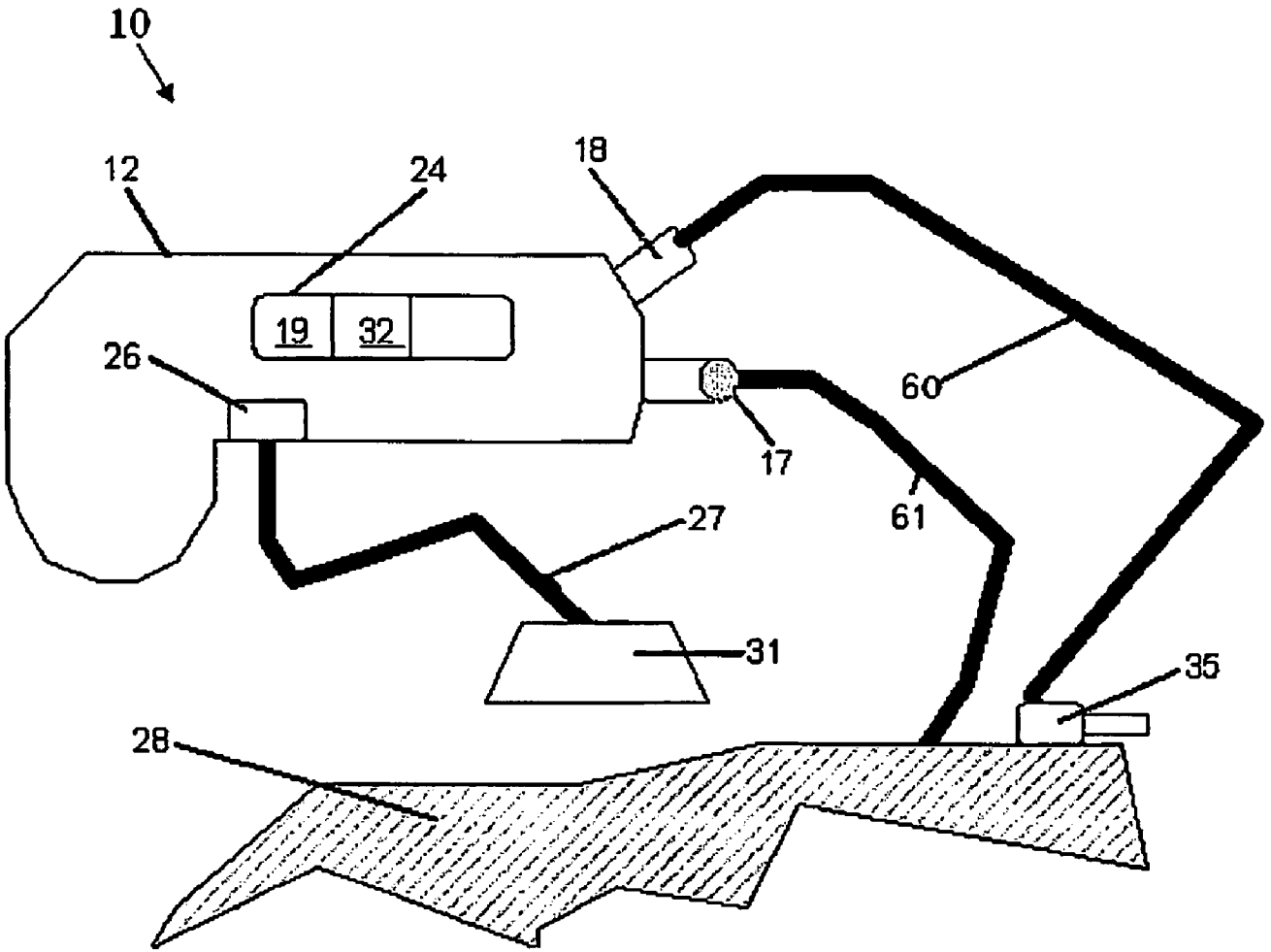
FIG. 3 depicts a schematic of the hydraulic torque wrench system usable with the embodiments of the invention.

A port 18 is connected to the hydraulic piston assembly. The port 18 is in fluid communication with a directionally controlled pump, as depicted in FIG. 3. The port 18 can have a first port 18 and a second port 17. The first port 18 is an input port, and the second port 17 is an output port.

A mechanical drive assembly 20 is engaged by the piston rod 32. A drive attachment 21 is secured to the mechanical drive assembly 20. The drive attachment 21 is adapted to engage a threaded fastener 23.

In the depicted embodiment, the piston rod 32 engages a drive pin 37 for driving the mechanical drive assembly 20. Specifically, the piston rod 32 engages a drive pin 37 for moving the drive pawl 36. A connector pin 19 couples the piston to the mechanical drive assembly. A magnet 24 is secured to the connector pin 19, such that the magnet will activate a switching device 26 when the piston is at the end of its stroke.

The switching device 26 is fixedly positioned on the interior of the housing 50. The switching device is adapted to form a signal circuit when the magnet is detected.

The mechanical drive assembly 20 has a drive pawl 36. The mechanical drive assembly 20 is depicted having two drive plates 38*a* and 38*b*. A drive ratchet spline 40 is part of the mechanical drive assembly. There are two bushing sleeves 40*a* and 40*b*. The bushing sleeves retain the drive bushing and provide the needed robustness for applying torque to threaded fasteners.

The mechanical drive assembly 20 can also include two drive bushings 42*a* and 42*b*. A holding pawl 44 and a holding pawl release lever 46*a* can be used to release the mechanical drive assembly.

Referring now to FIG. 3. An embodiment of the hydraulic torque wrench system 10 is depicted. The hydraulic torque wrench 12 is depicted having first port 18 in fluid communication with a directionally controlled pump 28, using hose 60.

The formed signal circuit 27 is depicted in communication with a processor 31. The signal circuit is formed when the magnet 24 is sensed by the switching device 26. For example as the piston travels through its stroke it will reach the end of the stroke, at this time the magnet will activate the switching device and the switching device will form a signal circuit which will notify the processor that the piston is at the end of its stroke. The signal circuit can be communicated to the processor by wireless transmission, hard wired transmission, fiber optics, or other similar forms of signal transmission.

The directionally controlled pump 28 is in fluid communication with the hydraulic wrench 12 in such as manner as to supply hydraulic fluid to the hydraulic wrench and to receive hydraulic fluid from the hydraulic wrench. In the depicted embodiment the hydraulic fluid is supplied using hose 60 and port 18. The fluid is received using the second port 17 and hose 61. It is possible to have the directionally controlled pump to only supply hydraulic fluid to the hydraulic wrench, and to have a separate reservoir for receiving hydraulic fluid from the hydraulic wrench.

The directionally controlled pump can have a pressure setting device 35. The pressure setting device 35 can be a digital sensor, an analog sensor, or a mechanical device such as a pressure relief valve. The pressure setting device will set the pressure at which the hydraulic fluid is supplied to the hydraulic wrench. The pressure is determined by the torquing requirements. The pressure setting device is depicted in communication with the processor.

While these embodiments have been described with emphasis on the embodiments, it should be understood that within the scope of the appended claims, the embodiments might be practiced other than as specifically described herein.

What is claimed is:

1. A method for automatically cycling a torque wrench comprising:

a. providing a hydraulic torque wrench;

b. providing a magnet on the hydraulic torque wrench;

c. providing a switching device on the hydraulic torque wrench;

d. adapting the switching device to be activated by the magnet when a piston of the torque wrench is at the end of a stroke;

e. communicating a directionally controlled pump with the hydraulic wrench;

f. setting an output pressure for the directionally controlled pump;

g. communicating the directionally controlled pump with a processor;

h. communicating the switching device with the processor;

i. adapting the processor to cycle the directionally controlled pump, when the switching device is activated; and wherein the processor stops the directionally controlled pump when the sensed output pressure reaches the set output pressure and the switching device is not activated.

2. The method of claim 1, wherein the pressure output is proportional to the torque provided by the hydraulic torque wrench.

3. The method of claim 1, wherein the magnet is movable mounted to a piston rod of the hydraulic torque wrench, and wherein the switching device is secured to a housing of the torque wrench.

4. The method of claim 1, further comprising sensing the output pressure.

5. The method of claim 4, further comprising communicating the sensed output pressure with the processor.

6. A method for automatically cycling a torque wrench comprising:

a. providing a hydraulic torque wrench;

b. providing an activation device on the hydraulic torque wrench;

c. providing a switching device on the hydraulic torque wrench;

d. adapting the switching device to be activated by the activation device when a piston of the torque wrench is at the end of a stroke;

e. communicating a directionally controlled pump with the hydraulic wrench;

f. setting an output pressure for the directionally controlled pump;

g. communicating the directionally controlled pump with a processor;

h. sensing the output pressure;

i. communicating the output pressure to the processor;

j. cycling the pump when the switching device is activated the and the sensed output pressure is equal to the set output pressure; and k. stopping the pump when the sensed output pressure is equal to the set output pressure, and the switching device is deactivated.

7. The method of claim 6, wherein the activation device is movable mounted to a piston rod of the hydraulic torque wrench, and wherein the switching device is secured to a housing of the torque wrench.

* * * * *